US006273387B1

(12) United States Patent
Miller

(10) Patent No.: US 6,273,387 B1
(45) **Date of Patent: *Aug. 14, 2001**

(54) HANGER FOR SUSPENDERS

(76) Inventor: Charles C. Miller, 385 Ashford Ave., Dobbs Ferry, NY (US) 10522

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/997,310

(22) Filed: Dec. 23, 1997

(51) Int. Cl.[7] ..... A47H 1/10
(52) U.S. Cl. ..... 248/317; 24/709.8; 206/296
(58) Field of Search ..... 248/317; 206/296; 24/709.8, 709.9, 710.2, 27

(56) References Cited

U.S. PATENT DOCUMENTS

| | | | | |
|---|---|---|---|---|
| D. 307,679 | | 5/1990 | Kolton et al. | D6/315 |
| 1,497,208 | * | 6/1924 | Calvert | 24/73 |
| 2,428,558 | * | 10/1947 | Drucker | 24/709.9 |
| 2,833,010 | * | 5/1958 | Rosenthal | 24/73 |
| 3,043,547 | * | 7/1962 | Reich | 248/317 |
| 3,530,545 | * | 9/1970 | Lengyel | 24/73 |
| 3,878,590 | * | 4/1975 | Bolger | 24/261 |
| 4,318,525 | * | 3/1982 | Welch | 248/228 |
| 4,690,288 | * | 9/1987 | Mitchell | 211/113 |
| 4,714,156 | * | 12/1987 | Kolton et al. | 206/296 |
| 4,718,546 | * | 1/1988 | Kolton et al. | 206/296 |
| 4,738,424 | * | 4/1988 | Conner | 248/304 |
| 4,759,440 | | 7/1988 | Kolton et al. | 206/296 |
| 4,765,467 | | 8/1988 | Kolton et al. | 206/296 |
| 4,768,649 | | 9/1988 | Kolton et al. | 206/296 |
| 4,834,248 | | 5/1989 | Lee | 211/13 |
| 4,865,235 | | 9/1989 | Amobi | 223/85 |
| 4,966,344 | * | 10/1990 | Gary | 248/317 |
| 5,421,465 | | 6/1995 | Dunner, Jr. | 211/115 |

* cited by examiner

*Primary Examiner*—Ramon O. Ramirez
*Assistant Examiner*—Kimberly Wood
(74) *Attorney, Agent, or Firm*—Pennie & Edmonds LLP

(57) ABSTRACT

A hanger is provided for suspenders of the type having three straps, each strap of the suspender having a pair of stems connected therewith, each stem having a slot extending therethrough for receipt of a garment button. The hanger has an engaging member in an open state for receiving the stem slot and in an engaged state for retaining the slotted end of a stem. A closing member is fixed to the engaging member for automatically closing the engaging member and for maintaining the engaging member in the engaged state. The hanger also has a body portion for connecting the engaging member and the closing member to a support structure so as to hang the suspenders to the support structure. The body portion is capable of allowing the engaging member in either the open state or the engaged state.

7 Claims, 6 Drawing Sheets

HANGER FOR SUSPENDERS

TABLE OF CONTENTS

1. BACKGROUND OF THE INVENTION
1.1. Technical Field
1.2. BACKGROUND ART
2. SUMMARY OF THE INVENTION
3. BRIEF DESCRIPTION OF DRAWINGS
4. DESCRIPTION OF THE PREFERRED EMBODIMENTS
4.1. EXAMPLE 1
4.2. EXAMPLE 2
4.3. EXAMPLE 3
4.4. EXAMPLE 4
4.5. EXAMPLE 5
5. CLAIMS
6. ABSTRACT OF THE DISCLOSURE
7. DRAWINGS
8. DECLARATION AND POWER OF ATTORNEY
9. VERIFIED STATEMENT (DECLARATION) CLAIMING SMALL ENTITY STATUS

1. BACKGROUND OF THE INVENTION

1.1. Technical Field

This invention relates generally to hangers for trouser suspenders or braces and more particularly to hangers for suspenders of the type having three straps, each strap having a pair of stems connected therewith, and each stem having a slot extending therethrough for engagement with a garment button.

1.2. Background Art

Numerous inventions have been made in order to solve the problem of hanging trouser suspenders when they are not in use. For example, U.S. Pat. No. 4,714,156 and 4,718,546 relate to means for hanging of suspenders of the type having stems with slots therein for engageably receiving buttons disposed interiorly on a trouser waistband. Such hangers are in the from of a flat body having an upwardly extending hook portion. In the '156 patent, the hanger has a pair of foldable strips, each strip being configured compatibly with suspender stems to receive and retain the slotted ends thereof. In the '546 patent, the hanger has a pair of openings extending therethrough and an elongate member is cantilever-supported in each opening and configured compatibly with a pair of suspender stems and their button slots to retain the stems by releasable engagement with the slots.

The aforementioned prior art is directed to solving the problems of displaying suspenders at the point of purchase without need for removing the suspenders from their containers. The structures of the hangers disclosed in both patents and their objects determine that they are useful for marketing purposes only; their structural features preclude their use for domestic and personal purposes to suit the needs of fastidious wearers. The main reasons for this are that they are not adapted for frequent use in hanging and releasing suspenders simply and quickly. For instance, the foldable straps in U.S. Pat. No. 4,714,156 are easily broken after multiple use. In addition, opening and closing suspender-engaging members consume time and are an inconvenience. The hanger disclosed in U.S. Pat. No. 4,718,546 is not capable of securely retaining the slotted stem under conditions of storage by the user. Thus, the personal and domestic use requirements for suspender hangers call for improvements in prior art versions.

In addition, materials suitable for use in fabricating hangers of the type disclosed in the above patents are determined by their purpose of service and the disclosed integral structure, particularly the foldable straps and the releasable engagement. In the case of plastic or similar synthetic materials, cost considerations in making moulds and cutting become problematic. For synthetic leather or other substitutes, experienced cutting skill is needed and the cost of appropriate cutting equipment is high. Therefore, the high cost and complex problems in manufacturing hangers needs to be addressed.

The present invention has as a primary object to provide simple and cheaply manufactured hangers for the hanging of the stem/slot type of suspenders to meet the needs of personal and domestic use, in addition to point-of-sale display requirements of haberdashers.

Another object of the invention is to provide hangers capable of being used very handily and quickly.

Yet another object of the invention to provide hangers capable of accurate engagement with the ends of stem/slot type suspenders.

2. SUMMARY OF THE INVENTION

The foregoing objects and advantages are achieved according to the present invention which provides a hanger for suspenders of the type having three straps, each strap having a pair of stems connected therewith, and each stem having a slot extending therethrough for receipt of and engagement with a garment button. The hanger comprises an engaging means which, in an open or separated state, is adapted for receiving the slot of a stem and, in a closed or engaged state, is adapted for retaining the slotted end of a stem; a closing means for automatically closing the engaging means and automatically maintaining the engaging means in the engaged state; and a body portion for connecting the said engaging means and closing means and being capable of allowing the said engaging means to remain in either the separated state or the engaged state.

Typically, the closing means is formed of a resilient component to close the engaging means automatically and maintain same automatically in the said engaged state.

The free ends of the body portion form two ends of the said engaging means, and at least a portion of the body portion is capable of deforming by being manually forced to separate the two ends of the engaging means.

The body portion and closing means merge into a integral device, and at least a portion of the device is made of a resilient material which forms the resilient component.

The device is integrally formed of a resilient material of such shape that the device is both capable of automatically closing the said engaging means and automatically maintaining the same in the said engaged state and is capable of being manually forced to separate the said engaging means.

More typically, the resilient material is a continuous resilient wire, bent in criss-cross configuration into a substantially planar "FIG 8" to form the device, two free ends of the wire forming the engaging means, and the upper lobe of the FIG. 8 being manually compressible to cause the engaging means to separate. A portion of the length of the wire is slotted for the purpose of passing one end of the wire thereof and to permit movement of the wire therein.

As an alternative, the resilient material is a continuous resilient wire, bent into a substantially planar circle to form the said device, the two ends of the wire forming the said engaging means, and the circle being manually deformable to cause the said engaging means to separate.

In addition, the hanger of the invention may be such that the body portion thereof is formed by two mutually swingable parts hinged with each other at a hinge shaft; the said resilient component is mounted on these two parts respectively, and being in such form as to be capable of automatically closing the said engaging means and automatically maintaining the same in the said engaged state.

To facilitate the joining of the engaging means, the invention further provides that one end of the engaging means is pointed and the other end of the means is provided with a longitudinal recess to receive the pointed other end.

Additionally, the hanger of the present invention can feature a body portion that comprises a substantially planar concave with an arm perpendicularly extending from one upward, fixed sidewall thereof and a rod being movable in respect of the arm; the said resilient component is set between the rod and the fixed sidewall of the concave to press the rod against the other upward, free end of the concave, the free end of the rod and the free end of the concave forming the said engaging means. Typically, the arm is formed into a hollow pipe having a longitudinal slot thereon; the rod is set in the pipe and has a protuberance perpendicularly extending therefrom, and passing through the longitudinal slot and movable therein, and said resilient component is a spring.

To facilitate setting the hanger, the invention provides hangers further comprising a short rod perpendicularly extending from the hanger.

A hook part comprising an upper hook and a lower aperture corresponding to the short rod is further provided to achieve particular service and to widen the use.

As a consequence of the surprisingly versatile simplicity of structure of the hangers of the present invention, they can be obtained through very easy, quick and low cost manufacturing methods. Their special structure permits their facile use not only for commercial display purposes but also at home for personal use. Thus, the hangers of the invention solve the longstanding problems of providing conventional suspender hangers effective for domestic use. They are usually attractive and durable due to being usually made of metal, which is a suitable material. The accessories for each particular service purpose widen their scope of utility and facilitate their use in particular cases.

3. BRIEF DESCRIPTION OF THE DRAWINGS

4. DESCRIPTION OF THE PREFERRED EMBODIMENTS

4.1. EXAMPLE 1

Figure 1:
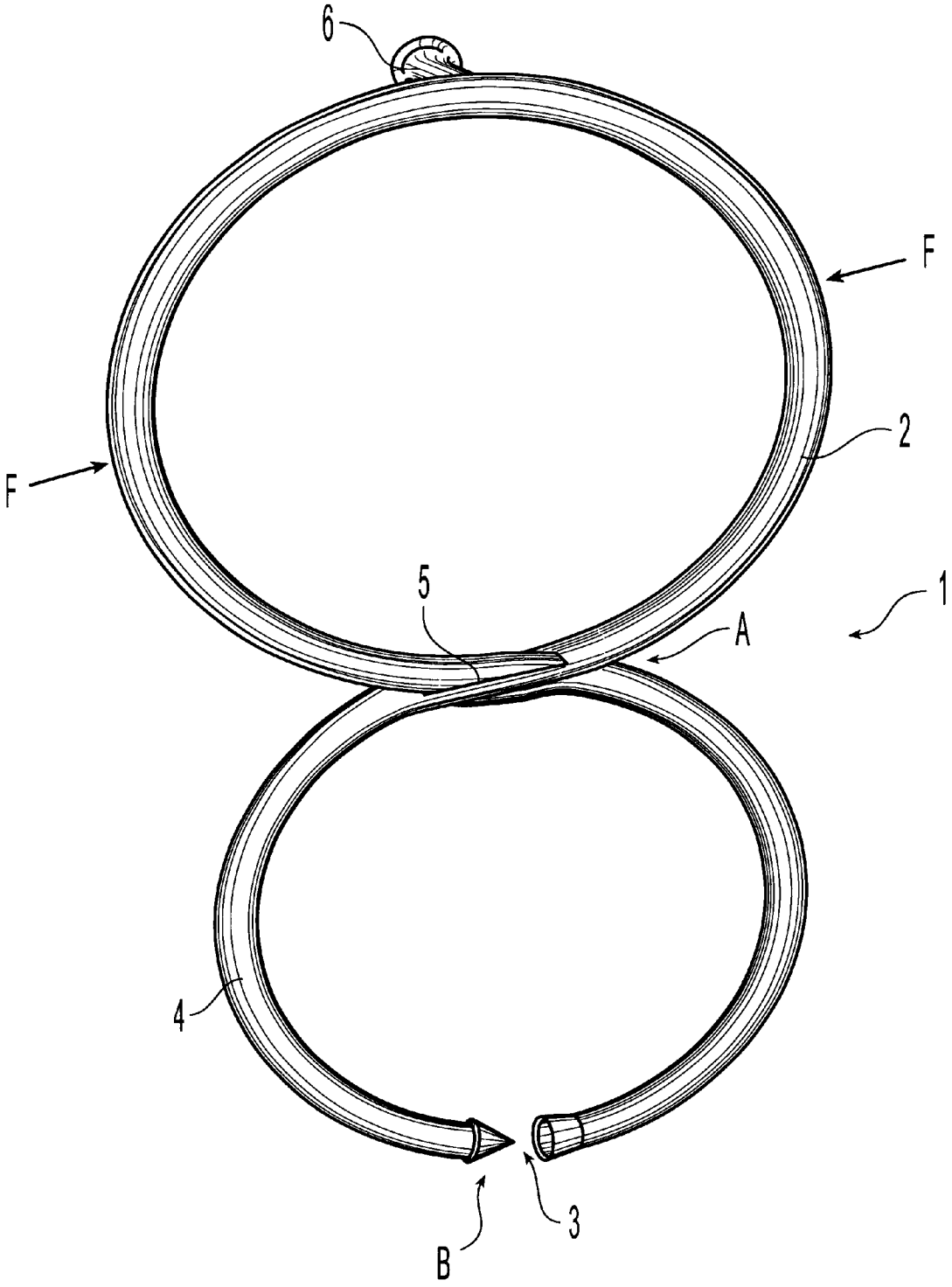
FIG. 1 is a perspective view of a first embodiment of the hanger of the present invention.

FIGS. 1, 2, 3 and 4 illustrate a first embodiment of the hanger of the invention. Referring to FIG. 1, a hanger 1 is formed into a substantially planar FIG. 8 configuration by a crisscross bend of a continuous resilient wire. The elasticity of the wire enables the upper side lobe 2 of the hanger 1 to be manually compressible to cause the ends 31 and 32 (shown in FIG. 3) to separate so as to let an end 31 or 32 to pass through a slot of the stem of a pair of suspenders.

This resiliency of the wire also causes the two ends of the wire 31 and 32 to be automatically closed and maintained in an engaged state in normal condition so as to retain the slotted stem of the suspenders.

Figure 2:
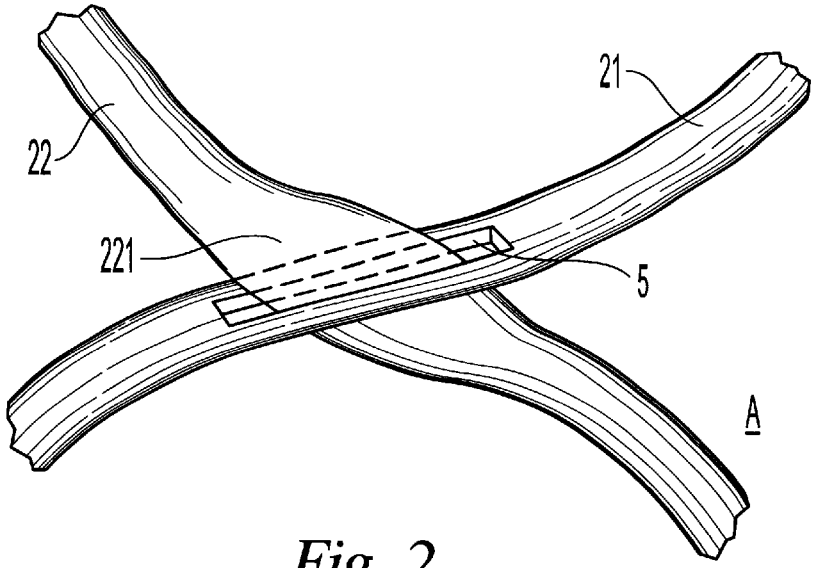
FIG. 2 is an enlarged view of part A of the hanger of FIG. 1.

Referring to FIG. 2, at the crisscross portion of the wire, one side arm 21 of the hanger 1 has a longitudinal slot 5 of a certain length, a portion of the other side arm 22 of the hanger 1 is flattened into a thinner portion 221 whose thickness is such that this thinner portion 221 is capable of passing through the slot 5 and to move smoothly within it.

Figure 3:
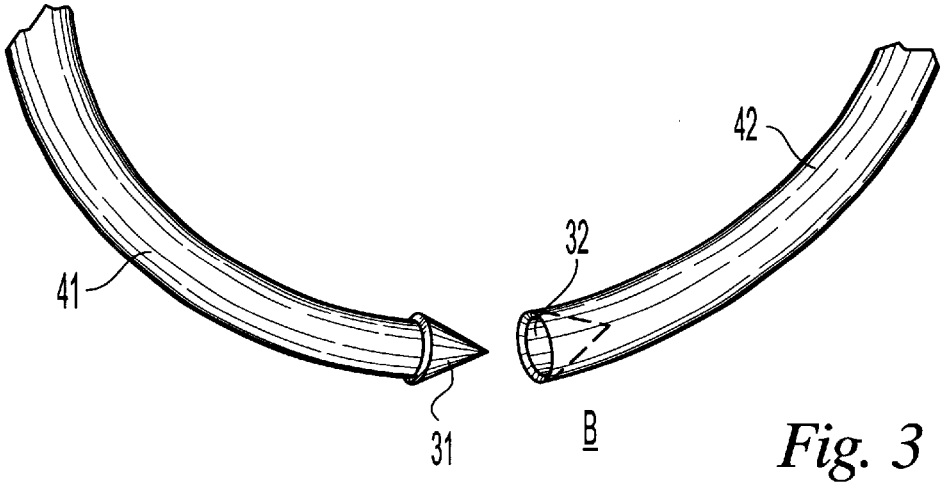
FIG. 3 is an enlarged view of part B of the hanger of FIG. 1.

Referring to FIG. 3, showing two ends 31 and 32, one end 31 is formed with a point and the other end 32 is provided with a longitudinal recess to receive the pointed end 31 whereby the mating engagement between these two ends is facilitated and stabilized.

Figure 4:
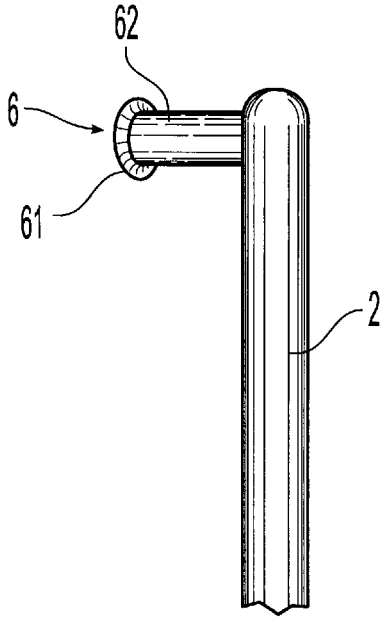
FIG. 4 is partial side elevational view of the hanger of FIG. 1.
Figure 5:
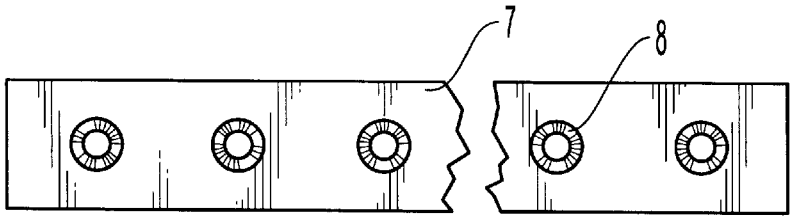
FIG. 5 is a front elevational view of a cross arm for facilitating the setting of the hangers of the invention in a desired position.
Figure 6:
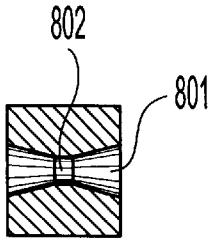
FIG. 6 is a side sectional view of the cross arm of FIG. 5.

At the top of the hanger 1, there is provided a short rod 6 perpendicularly extending from the hanger 1, as shown in FIG. 1. Referring to FIG. 4, an enlarged portion 62 is formed at the free end of the short rod 6 for the purpose of facilitating a short shank 61 to be retained within a corresponding aperture. Referring to FIG. 5, a cross arm 7 having a plurality of apertures 8 corresponding to the short rod 6 is adapted to be put to use in a wardrobe to set a number of hangers 1 in desired positions. Each aperture 8 has a part 802 thereof of diameter about equal to the cross-section of shank 61 of the short rod 6 and a tapered entry part 801 of larger entry diameter, about equal to that of enlargement 62, so as to facilitate the receipt and/or the release of the rod 6. The rod 6 may be provided at any suitable portion of hangers and this kind of combination can be also used in stores for displaying the suspenders.

Figure 7:
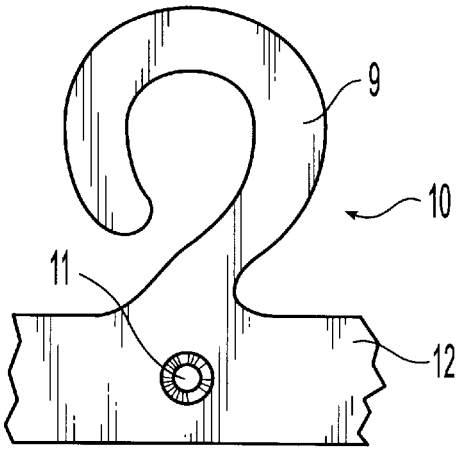
FIG. 7 is a front elevational view of a hook part to permit the hangers of the invention to be hung in a desired position.
Figure 8:
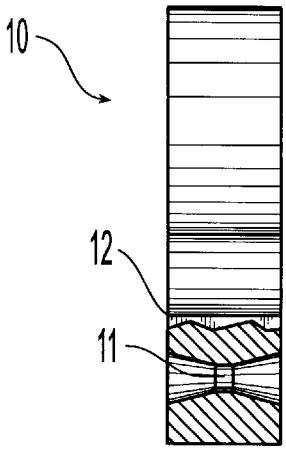
FIG. 8 is a side elevational view of the hook part of FIG. 6.

Alternatively, a hook part 10 as shown in FIG. 7 and 8 can also facilitate the setting of hangers and widen the service scope of the hangers of the invention. Referring to FIG. 7, hook part 10 is in the form of a flat body having a hook portion 9 upwardly thereof and an aperture 11 formed at the lower part of a logo display area 12 as so to be assembled with hangers or disassembled to achieve varied service. For the same purpose, the aperture 11 is formed similarly to apertures 8, as shown in FIG. 8, to facilitate the receipt and/or the release of the rod 6. Thus, the hanger 1 may be set at any suitable and/or desired position to suit the varied requirements of particular applications.

In addition, the rod 6 may be a magnet to facilitate hangers to be set handily and quickly.

4.2. EXAMPLE 2

Figure 9:
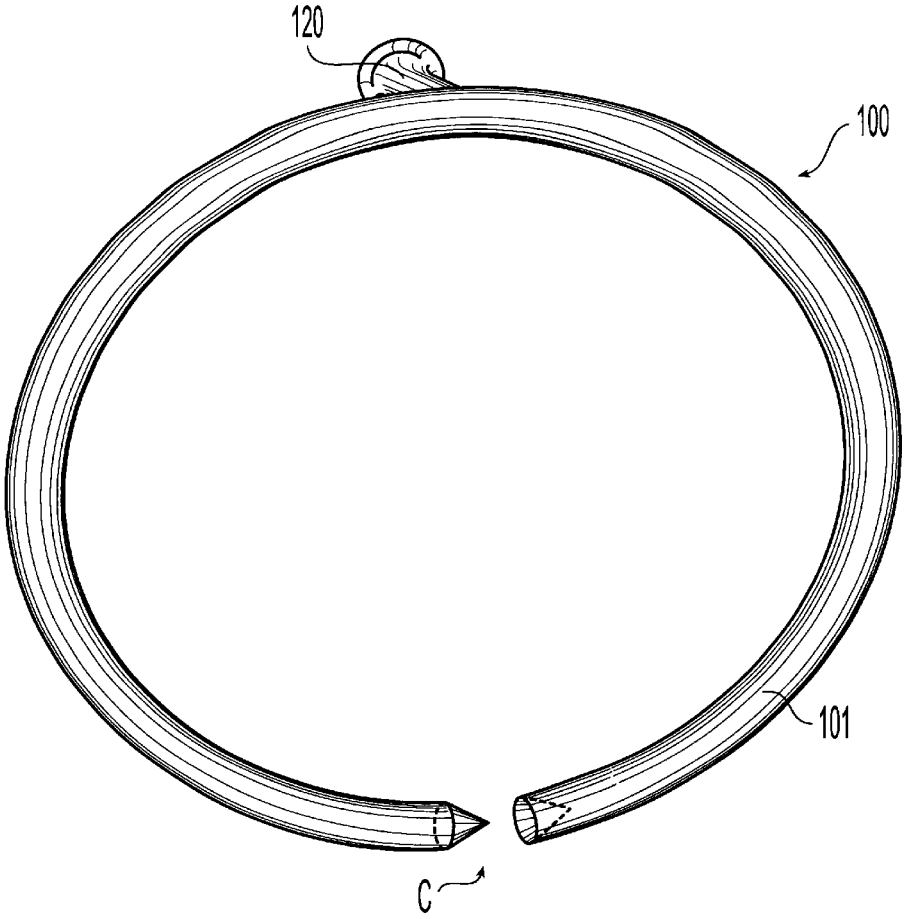
FIG. 9 is a perspective view of a second embodiment of the hanger of the invention.
Figure 10:
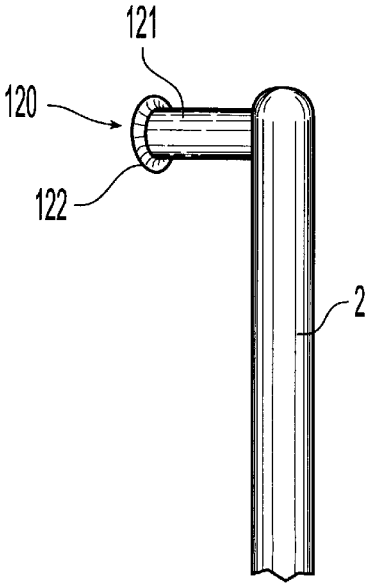
FIG. 10 is a partial side elevational view of the hanger of FIG. 9.
Figure 11:
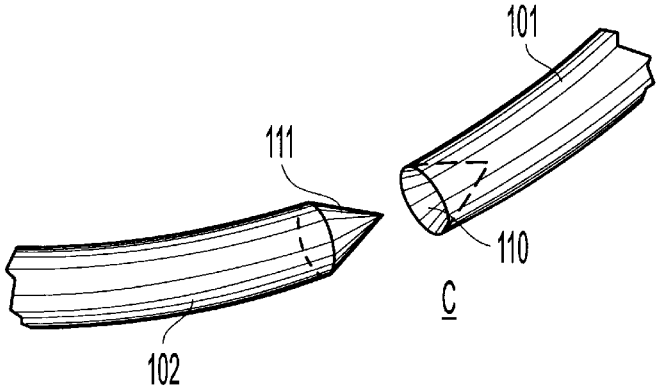
FIG. 11 is an enlarged view of part C of the hanger of FIG. 9.

FIG. 9, 10 and 11 illustrate a second embodiment of the hanger of the invention. In FIG. 9, a hanger 100 is formed into a substantially planar circle or an oval by being bent from a continuous resilient wire. The elastic nature of the wire enables the two side arms of the wire 101 and 102 to be manually pullable to cause the ends 110 10 and 111 to separate so as to let either end 110 or end 111 to pass through a slot of the stem of a pair of suspenders. This elasticity or resiliency of the wire also enables these two ends to be automatically closed and maintained in engaged state in normal condition so as to retain the slotted suspender stem.

For the same purpose, the ends 110 and 111 of hanger 100, as shown in FIG. 11, are formed similarly to ends 31 and 32 of hanger 1 into such structure that one is pointed and the other is provided with a longitudinal recess to receive the pointed end and whereby facilitate and stabilize the mating engagement of the two ends.

A rod 120, as shown in FIG. 10, extends perpendicularly from the top of the hanger 100. Its structure may be similar to the rod 6 of the hanger 1 to cooperate with the aperture 8 or 11 of the cross arm 7 or hook part 10 for setting hangers in any desired position and/or achieving varied service.

4.3. EXAMPLE 3

Figure 12:
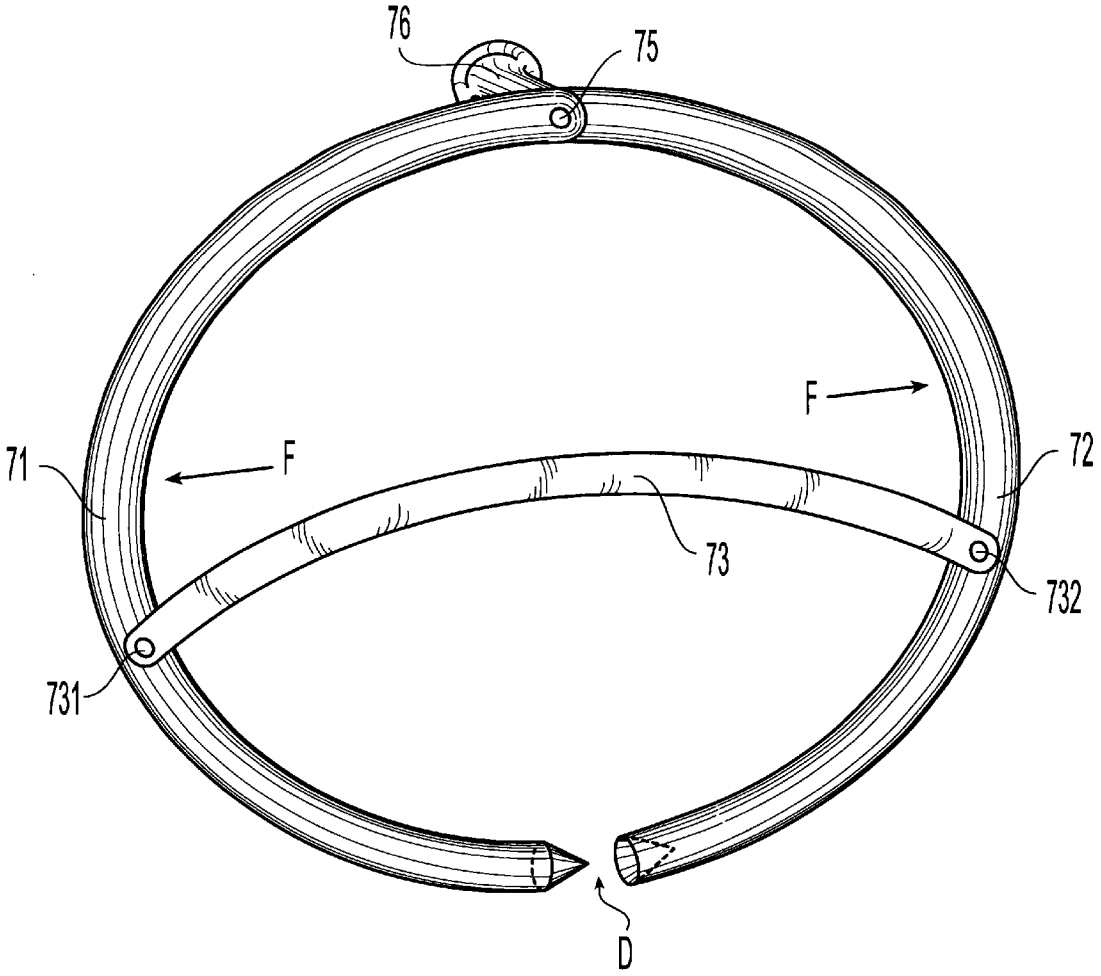
FIG. 12 is a perspective view of a third embodiment of the hanger of the invention.
Figure 13:
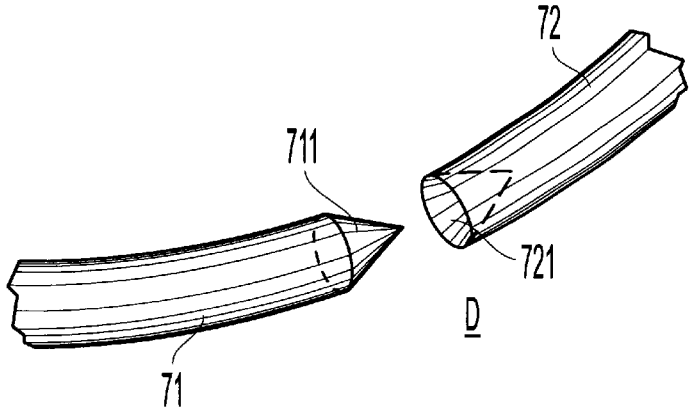
FIG. 13 is an enlarged view showing part D of the hanger of FIG. 12.

FIGS. 12 and 13 illustrate a third embodiment of the hanger of the invention. A hanger 70 comprises two semicircle or semi-oval arms 71 and 72, which are hinged with each other at the hinge shaft 75 so that they are capable of swinging with each other. A curved wire 73 made of a resilient material has its ends 731, 732 mounted on these two arms 71 and 72 respectively to automatically close the ends 711 and 721 to maintain them in an engaged state in normal condition. When manually pulling the two arms 71 and 72, the engaged ends 711 and 721 separate to let either end 711 or 721 to pass through a slot of the stem of suspenders. On withdrawing the force, the resilient curved wire 73 causes the ends 711 and 721 to be closed and maintained in engaged state to retain a slotted stem. The ends 711 and 721, as shown in FIG. 13, have the structure similar to ends 31 and 32 to facilitate the stable mating engagement of the ends. For the same purpose, a rod 76 is provided on the hanger 70 to facilitate the setting of the hanger.

4.4. EXAMPLE 4

Figure 14:
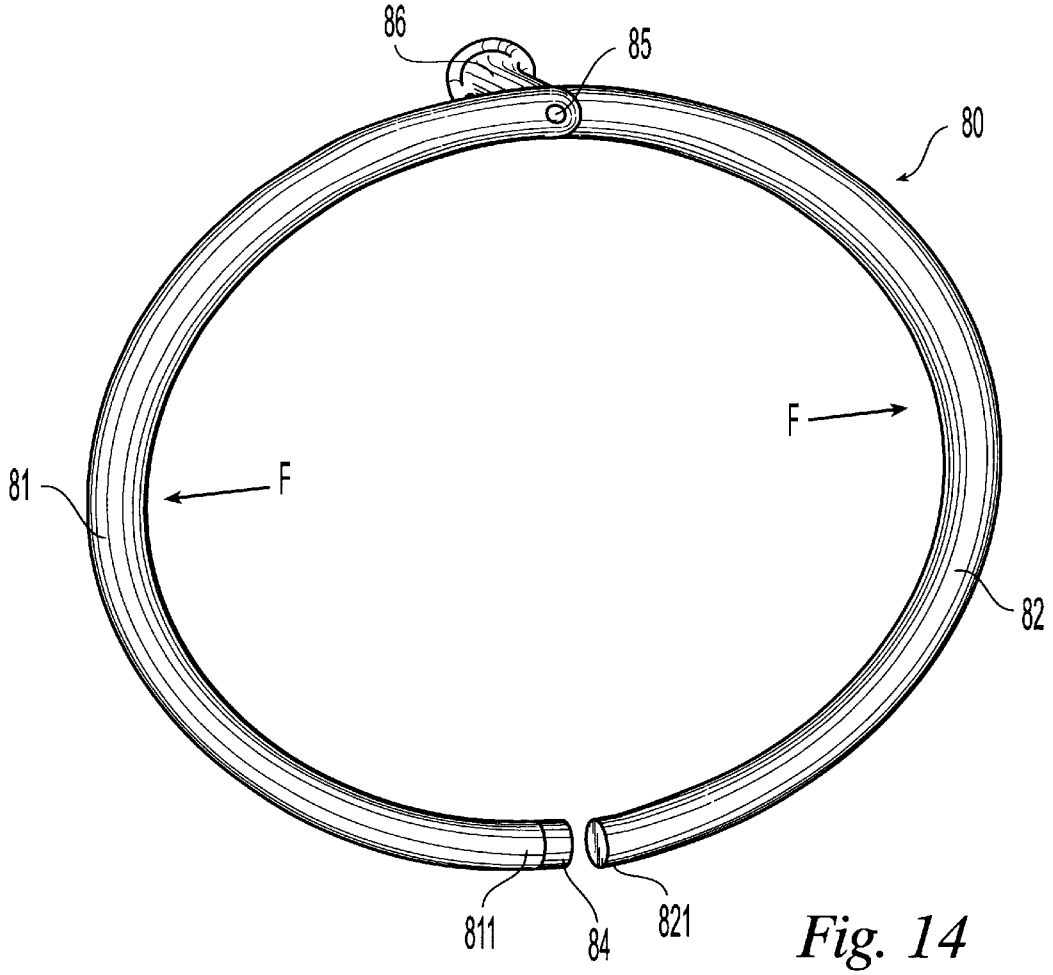
FIG. 14 is a perspective view of a fourth embodiment of the hanger of the invention.

FIG. 14 illustrates a forth embodiment of the hanger of the invention. A hanger 80 comprises two semicircle or semi-oval arms 81 and 82, which are hinged with each other at the hinge shaft 85 so that they are capable of swinging with each other. A magnetic element (for example, made of magnetic iron) 84 is mounted on one end 811 to automatically close the ends 811 and 821 and maintain these two ends in engaged state. When manually pulling the two arms 81 and 82, the engaged ends 811 and 821 separate to let any end 811 or 821 pass through a slot of the stem of suspenders. On withdrawing the force, the magnetic iron 84 cause the ends 811 and 821 to be automatically closed and maintained in engaged state. For the same purpose, a rod 86 with the structure similar to rod 6 is provided on the hanger 80 to facilitate the setting of the hangers.

4.5. EXAMPLE 5

Figure 15:
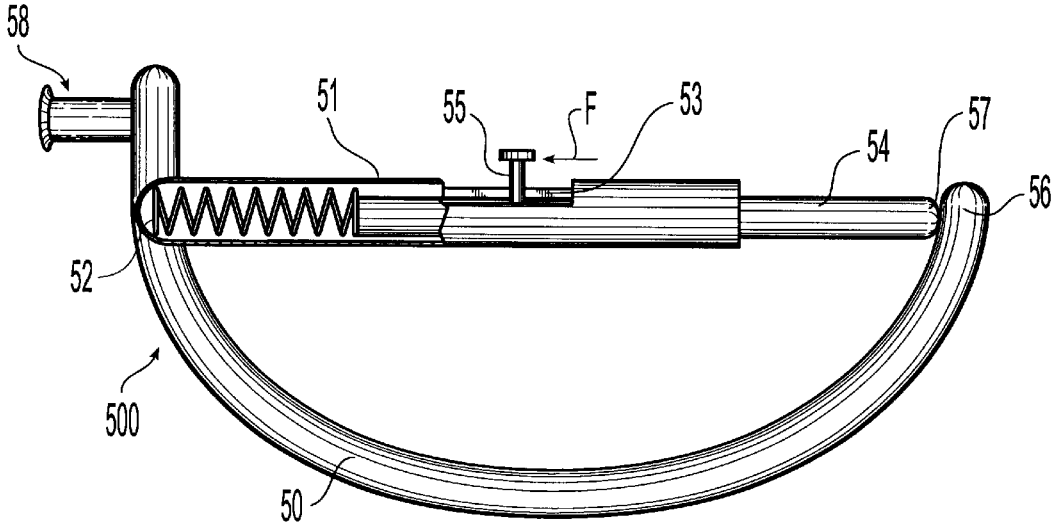
FIG. 15 is a perspective view of a fifth embodiment of the hanger of the invention.

FIG. 15 illustrates a fifth embodiment of the hanger of the invention. A hanger 500 comprises a substantially planar concave 50 preferably of metal. A hollow pipe 51 having a longitudinal slot 53 with a certain length slotted thereon is fixed on one upward side arm of the concave 50. A rod 54 is set in the hollow pipe 51 and capable of flexibly moving therein. A spring 52 is set between the rod 54 and the fixed side arm the concave 50 to press the rod 54 against the free end 56 of the concave 50. A short rod 55 is fixed on the rod 54 and is perpendicularly extending therefrom. It passes through the longitudinal slot 53 of the pipe 51 and is capable of flexibly moving therein to manually open the engaging ends 56 and 57 so as to let the end 56 pass through a slot of the stem of suspenders. On withdrawing the manual force, the spring 52 press the rod 54 against the end 56 to maintain two ends 56 and 57 in engaged state to retain the slotted stem of suspenders. A rod 58 being similar to the rod 6 or 120 is provided on the hanger 500 to facilitate the setting of the hanger 500.

In addition, the dimensions of the wire or the concave are selected in relation to the diameter of the slot of the stem to permit assembly.

While the invention disclosed herein is well calculated to fulfill the objects stated above, it will be appreciated that numerous modifications and embodiments may be devised by those skilled in the art, and it is intended that the appended claims cover all such modifications and embodiments are within the scope of the present invention.

What is claimed is:

1. A hanger for suspenders that have three straps, each strap having a pair of stems connected therewith, each stem having a slot extending therethrough for receipt of a garment button, comprising:

an engaging means in separated state for receiving the slot of a stem and in engaged state for supporting and retaining the slotted end of the stem, said engaging means forming an enclosed loop in said engaged state;

a closing means for automatically closing the said engaging means and for maintaining the said engaging means in the said engaged state; and a body portion for connecting the engaging means and the closing means to a support member so as to hang the suspenders to the support member and being capable of allowing the said engaging means in either the said separated state or the said engaged state, wherein said engaging means, said closing means and said body portion are in the form of an integral wire member; said engaging means having two ends formed on the free end portions of said wire member, said ends of said engaging means being a pointed end and a longitudinal recess for receiving said pointed end in the engaged state; said closing means is capable of forcing said body portion and said engaging means into a closed loop structure; and said closing means and said engaging means maintain the closed loop structure in said engaged state.

2. A hanger according to claim 1, wherein the closing means is formed of a resilient component adapted automatically to close and maintain the engaging means in the engaged state.

3. A hanger according to claim 2, wherein the body portion has two free ends which form two ends of the engaging means, and at least a portion of the body portion is capable of deforming by being manually forced to separate the two ends of the engaging means.

4. A hanger according to claim 3, wherein the body portion and closing means merge into an integral device, and at least a portion of the device is made of a resilient material adapted to form the resilient component.

5. A hanger according to claim 1 wherein said hanger further comprises a short rod perpendicularly extending from the hanger.

6. A hanger according to claim 5, further comprising a hook part comprising an upper hook and a lower aperture corresponding to the said short rod.

7. A hanger device for suspending articles with a loop portion, comprising:

a body member for connecting to a supporting member so as to suspend the article thereto, the body portion being capable of allowing the engaging member in either the open state or the engaged state;

an engaging member fixed to the body member, the engaging member being capable of receiving the loop portion in a separated state and retaining the article in an engaged state; and a closing member for automatically closing the engaging member and for maintaining the engaging member in the engaged state;

wherein the engaging member, the closing member and the body portion form an integral wire member; said engaging member having two ends formed on the free end portions of said wire member, said ends of said engaging member being a pointed end and a longitudinal recess for receiving said pointed end in the engaged state; and the body member and the engaging member form an enclosed loop structure in the engaged state.

* * * * *